United States Patent [19]

Lund

[11] 3,964,711

[45] June 22, 1976

[54] BRACKET FOR ENGAGEMENT WITH THE RUNG AND RAIL OF A LADDER FOR SUPPORTING AN ARTICLE

[76] Inventor: Ordell R. Lund, 1915 E. Ninth St., Duluth, Minn. 55812

[22] Filed: June 25, 1975

[21] Appl. No.: 590,022

[52] U.S. Cl. ..... 248/210; 248/311.1

[51] Int. Cl.[2] ..... B44D 3/14

[58] Field of Search ..... 248/210, 211, 238, 311; 211/71, 72

[56] References Cited

UNITED STATES PATENTS

| | | | |
|---|---|---|---|
| 1,047,251 | 12/1912 | Larson | 248/211 |
| 1,880,319 | 10/1932 | Iasillo | 248/211 |
| 3,239,180 | 3/1966 | Bachmann | 248/210 |
| 3,757,380 | 9/1973 | Jackson | 248/211 X |

*Primary Examiner*—J. Franklin Foss

*Attorney, Agent, or Firm*—Wicks & Nemer

[57] ABSTRACT

A device for mounting articles on a ladder including a main support having an end portion terminating in a lip for engagement with the rung and rail of a ladder together with means carried by said support for mounting articles thereon.

2 Claims, 11 Drawing Figures

BRACKET FOR ENGAGEMENT WITH THE RUNG AND RAIL OF A LADDER FOR SUPPORTING AN ARTICLE

SUMMARY

The invention relates to an improvement in a device for mounting articles on a ladder. The device includes a bracket mechanism which is simple and easy to fabricate and which is simple and easy to engage with a rung and rail of a ladder with no need for screws clamps or the like. The device has means for mounting an article or articles thereon.

In the drawings forming part of this applicatin:

Figure 2A:
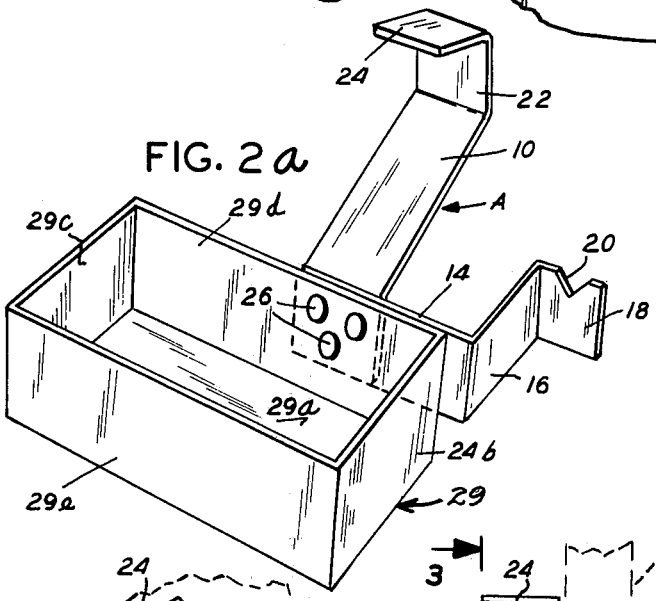
FIG. 2 is a perspective view of the bracket.
Figure 2:
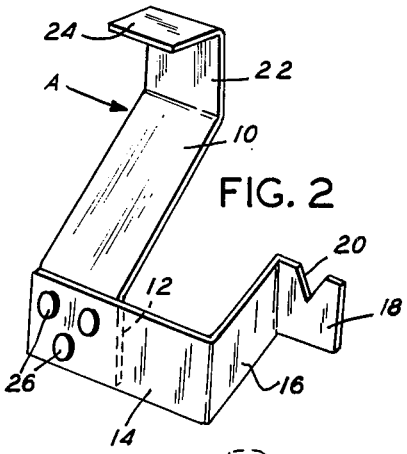

FIG. 2*a* is a perspective view of the bracket with a tray connected therewith.

Figure 3:
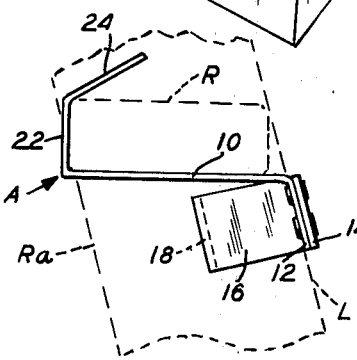

FIG. 3 is a side elevational view of the bracket in position on a ladder shown in broken lines.

Figure 4:
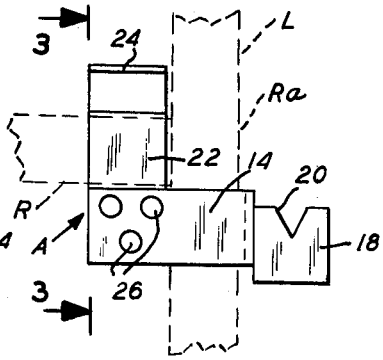

FIG. 4 is a front elevational view of the bracket as in FIG. 3.

Figure 5:
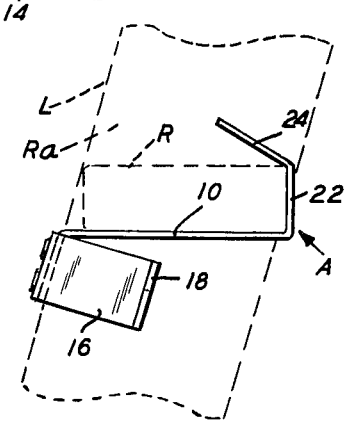

FIG. 5 is a side elevational view opposite to that of FIG. 3.

Figure 6:
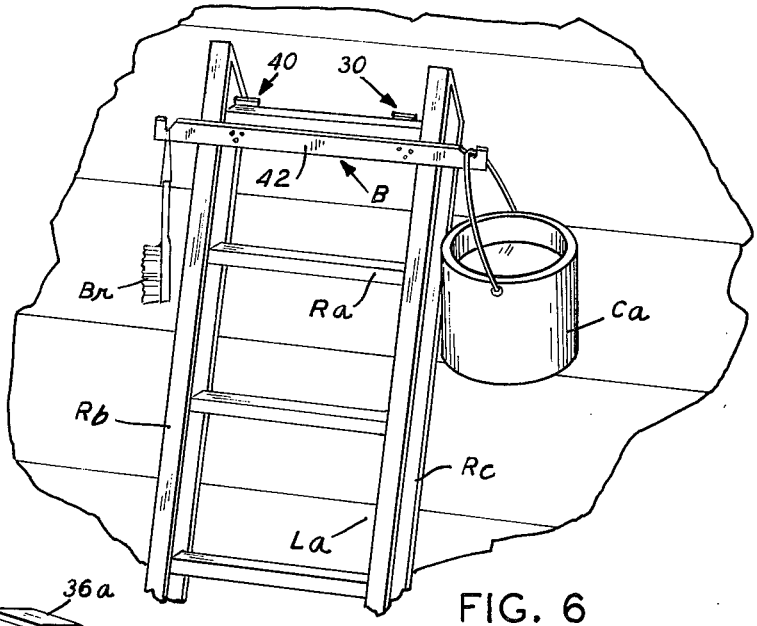

FIG. 6 is a perspective view of a further embodiment of a bracket for mounting a paint can and the like on a ladder partially shown.

Figure 7:
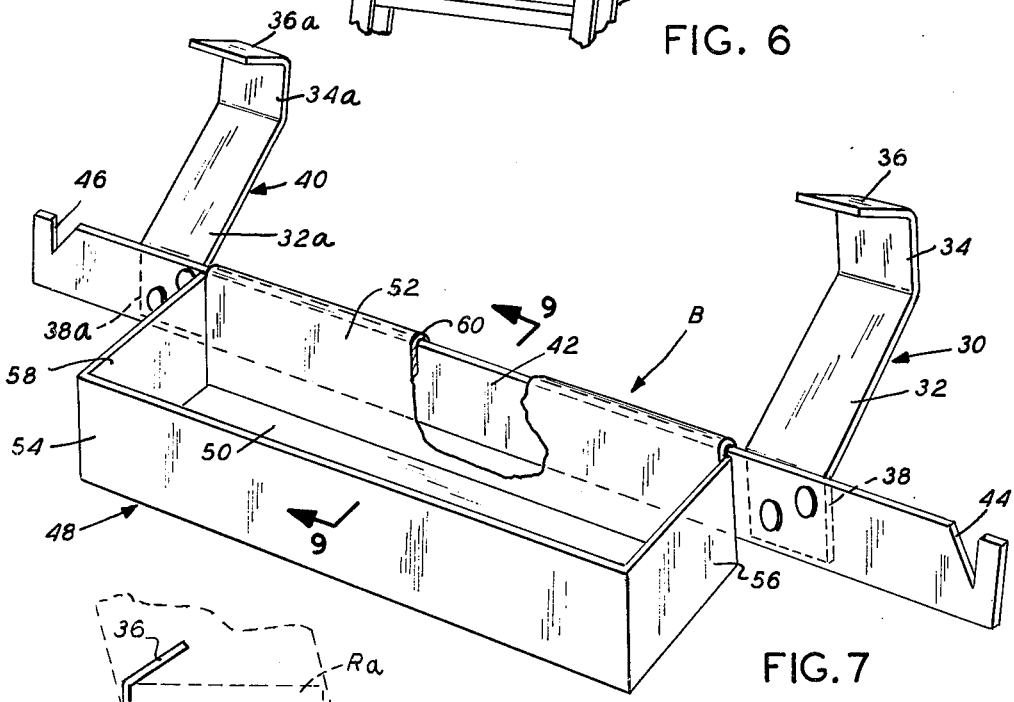

FIG. 7 is a perspective view of the bracket of FIG. 6 with a tray mounted thereon.

Figure 8:
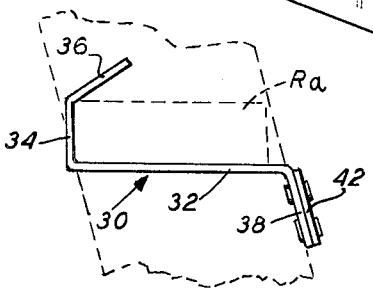

FIG. 8 is a side elevational view of the bracket of FIGS. 6 and 7 in position on a ladder shown in broken lines.

Figure 9:
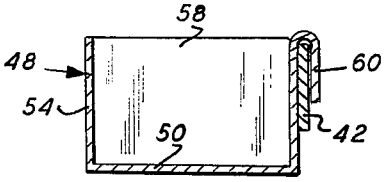

FIG. 9 is a sectional view on the line 9—9 of FIG. 7.

Figure 10:
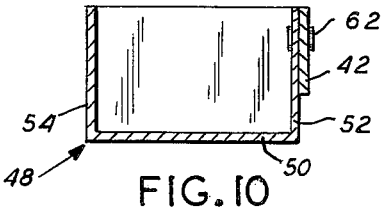

FIG. 10 is a sectional view on the line 9—9 of FIG. 7 but with the sidewall of the tray riveted to the bar member.

Referring to the drawings in detail, the bracket A includes the main arm 10 which is connected to and formed as part of the angularly disposed end portion 12. The end portion 12 is connected to the cross member 14 at one end thereof. The other end of the cross member 14 terminates in the wing portion 16 which is substantially at a right angle to the cross member 14. The wing portion 16 terminates in the right angular flange portion 18, and formed in the upper edge of the flange 18 is the notch 20.

The main arm 10 has formed on the opposite end thereof the angularly disposed end portion 22 which terminates in the lip 24. The end 12 may be secured to the cross member 14 as with the rivets 26 or formed as a part thereof as by stamping or molding of plastic.

Figure 1:
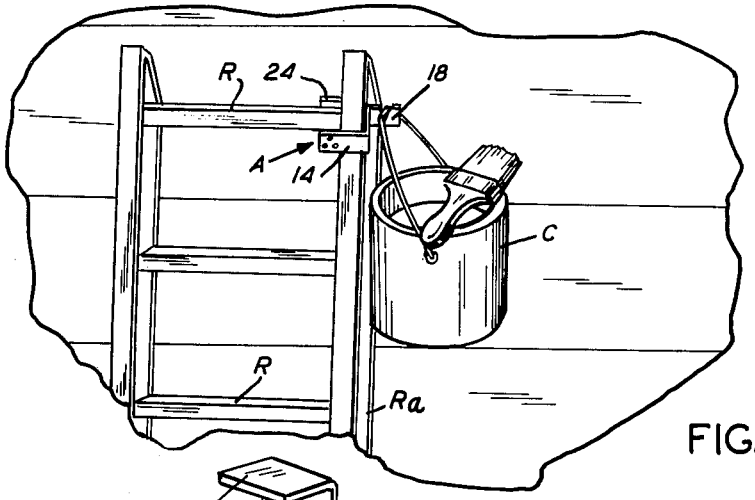
FIG. 1 is a perspective view of a ladder bracket for mounting a paint can or the like on a ladder partially shown, and embodying the invention.

In use of the bracket A, the end portion 22 is engaged against the rear edge of the rung R of the ladder L with the cross member 14 positioned upon the edge of the rail Ra of the ladder with the rail Ra between the main arm 10 and the wing portion 16 and the end portion 22 abutting the edge of the rail R. The upper rear corner of the rung of the ladder engages under the lip 24 at its juncture with end portion 22. In this position as in the Figures the bracket is mounted on the ladder against displacement without screws, clamps or the like, and in the mounted position an article, such as a paint can, can be hung from the flange 18 by engaging the bail of the paint can C in the notch 20 whereby the can is held against the rail of the ladder as illustrated in FIG. 1. It will be seen that with the can held in such a manner the brush may be easily and conveniently dipped into and withdrawn from the can or rested upon the can. Other articles used in repair such as a drill, putty knife, saw, and the like may be engaged on the flange 18 for easy access to by a party using the ladder.

In FIG. 2*a* is illustrated a further embodiment of the invention of FIGS. 1–5 wherein the bracket A has secured to the end portion 12 thereof the tray 29 formed of the bottom 29*a*, the ends 29*b* and 29*c*, and the sides 29*d* and 29*e*. The side 29*d* is secured to the end portion 12 whereby the tray is held in position to hold articles for easy access when the bracket A is attached to the ladder as in FIGS. 1, 3, 4 and 5.

Referring to the embodiment of FIGS. 6–10, the bracket B includes the first connector 30 which includes main arm 32. The main arm 32 terminates at one end in the angularly disposed first end portion 34 which in turn terminates in the lip 36. The other end of the main arm 32 terminates in the angularly disposed second end portion 38.

Further provided is a second connector 40 which is identical to the first connector 30, and identical reference numerals indicate identical portions but accompanied by a lower case letter *a*.

The numeral 42 designates a bar which is connected at a right angle to the end portion 38 of the first connector 30 adjacent to but spaced from the end of the bar. The second connector 40 is connected to the bar 42 in the same manner, and the connectors are spaced such that distance between the outer edges of the connectors is only slightly less than the distance between the inner edges of the rails Rb and Rc of the ladder La whereby the connectors 30 and 40 are mounted between the rails with the bar 42 upon the front edge of the rails. The bar 42 has formed on one end thereof the notch 44 outwardly of the connector 30 and on the other end the notch 46 outwardly of the connector 40.

In use of the bracket B, the lips 36 and 36*a* are positioned so as to engage over the top of the rung with the end portions 34 against the rear edge of the rung Ra and the main arm 32 underneath the rung with the bar 42 upon the front edge of the rails Rb and Rc. In this position the bracket B is mounted on the ladder against displacement without screws, clamps or the like and in such a position an article such as a paint can can be hung from the notch 44 or notch 46 or a brush Br may be hung from a notch all as illustrated in FIG. 6. With the paint can Ca, for example, held in the position of FIG. 6 it is conveniently accessible to dip a paint brush into for one using the ladder Rc.

FIG. 7 illustrates the bracket B with the tray 48, the tray 48 including the bottom 50, the sidewalls 52 and 54 and the end walls 56 and 58. Depending from the top edge of the sidewall 52 and spaced slightly therefrom is the lip 60 which engages over the bar 42, particularly FIGS. 7 and 9, whereby the tray is removably mounted on the bar 42 and easily accessible for containing articles used in repair jobs while using the ladder La. The sidewall 52 of the tray without the lip 60 may also be permanently secured to the bar 42 by rivets 62 or the like as illustrated in FIG. 10. Additionally, the tray 48 may be mounted in the same manner on the side of the bar 42 opposite to that shown in FIG. 9.

I claim:

1. A device for mounting articles on a ladder comprising:

a. a pair of brackets each having a main arm which terminates in b. a first angularly disposed end portion for engagement with the rung of a ladder and which terminates in a lip angularly disposed to said first end portion and overlying said main arm to form a hook formation, for engagement with the rung of a ladder, c. said main arm terminating at its second end in a second angularly disposed end portion, d. a bar connected to said second angularly disposed end portion of each of said brackets for positioning across the rails of a ladder, e. a tray, and f. means for mounting a tray on said bar.

2. A device for mounting articles on a ladder comprising:

a. a flat rectilinear main arm for engagement with the underside of the rung of a ladder and positioned inside the side rail of the ladder, b. one end of said flat main arm terminating in a flat end portion angularly disposed to said main arm for contact with the edge of the side rail of the ladder, c. a flat cross member secured at one end to said flat end portion normal to the longitudinal axis of said main arm and adapted to lie flat upon the face edge of the rail of the ladder, d. said flat cross member terminating at the other end in a right angularly disposed flat wing portion parallel to said main arm adapted to engage the outer side edge of a ladder rail with a side edge of said main arm in engagement with the inner side edge of a ladder rail, e. said wing portion terminating in a right angle flat flange, f. said flat flange having means for engagement by an article for support of the article thereon, g. the other end of said flat main arm terminating in a flat end portion angularly disposed to said flat main arm for engagement with the rung of a ladder, h. said flat end portion terminating in a flat lip angularly disposed to said flat end portion and overlying said main arm portion for engagement with the rung of a ladder.

* * * * *